US008029724B2

(12) United States Patent
Samuelsson et al.

(10) Patent No.: US 8,029,724 B2
(45) Date of Patent: Oct. 4, 2011

(54) METHOD OF MAKING A CUTTING INSERT WITH A HOLE FOR CLAMPING

(75) Inventors: Peter Samuelsson, Stockholm (SE); Per Lindskog, Älvsjö (SE); Hans Fernros, Bandhagen (SE)

(73) Assignee: Sandvik Intellectual Property AB, Sandviken (SE)

( * ) Notice: Subject to any disclaimer, the term of this patent is extended or adjusted under 35 U.S.C. 154(b) by 467 days.

(21) Appl. No.: 12/339,452

(22) Filed: Dec. 19, 2008

(65) Prior Publication Data

US 2009/0169412 A1 Jul. 2, 2009

(30) Foreign Application Priority Data

Dec. 27, 2007 (SE) ..... 0702869

(51) Int. Cl.
*B22F 3/03* (2006.01)

(52) U.S. Cl. ..... 419/68

(58) Field of Classification Search ..... 425/78; 419/68

See application file for complete search history.

(56) References Cited

U.S. PATENT DOCUMENTS

| | | | |
|---|---|---|---|
| 6,645,426 | B1 | 11/2003 | Yoshihara et al. |
| 6,986,866 | B2 | 1/2006 | Gubanich et al. |
| 2004/0086415 | A1 | 5/2004 | Gubanich et al. |

FOREIGN PATENT DOCUMENTS

| | | |
|---|---|---|
| GB | 2 012 654 A | 8/1979 |
| JP | 10-118796 | 5/1998 |
| JP | 10-146695 | 6/1998 |

*Primary Examiner* — Sikyin Ip
*Assistant Examiner* — Yoshitoshi Takeuchi
(74) *Attorney, Agent, or Firm* — Drinker Biddle & Reath LLP

(57) ABSTRACT

A method of making a cutting insert using powder metallurgical methods including using a press with a main pressing direction and a press tool setup with a die, a male core rod, a female core rod, a bottom punch, a top punch and a feed shoe. The insert has a noncylindrical hole perpendicular to the main pressing direction, herein referred to as a cross-hole. A cross-hole with increased dimensional accuracy is obtained if the powder also is compacted by the two core rods.

3 Claims, 5 Drawing Sheets

FIG. 1
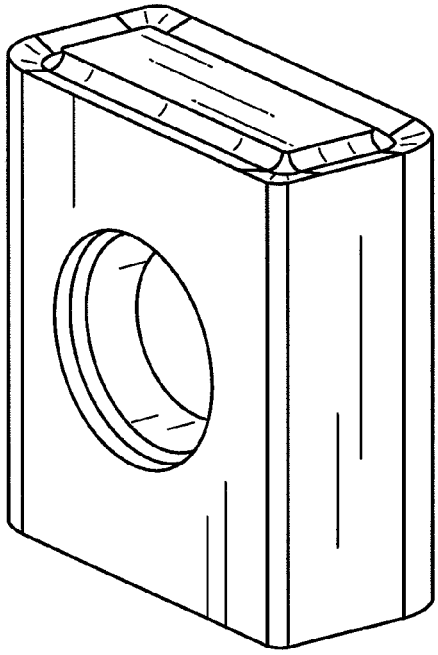
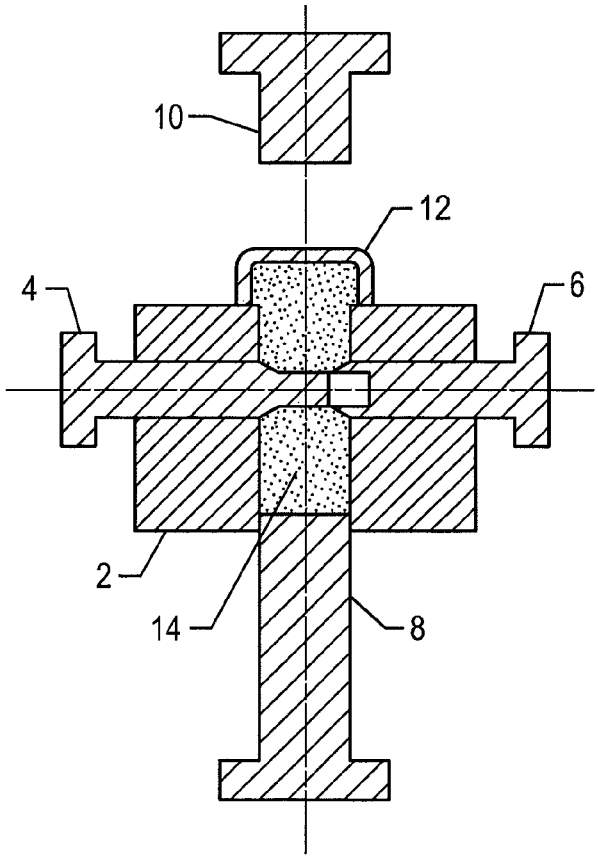
FIG. 2

METHOD OF MAKING A CUTTING INSERT WITH A HOLE FOR CLAMPING

RELATED APPLICATION DATA

This application claims priority under 35 U.S.C. §119 and/or §365 to Swedish Application No. 0702869-9, filed Dec. 27, 2007, the entire contents of which are incorporated herein by reference

FIELD

The present disclosure relates to relates to a method of making a cutting insert using powder metallurgical methods including using a press with a main pressing direction. The insert has a noncylindrical hole perpendicular to the main pressing direction, herein referred to as a cross-hole. According to the method a noncylindrical cross-hole with improved tolerances is obtained.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Manufacture of cutting inserts by powder metallurgical methods includes compaction in a press of a powder into a body, and subsequent sintering of the body to produce a cutting insert. Compaction takes place under high pressures obtained through large axially opposing forces generated by top and bottom punches moved into a cavity formed in a die containing the powder. The pressed body generally has a shape such that it easily can be removed from the die. This means that the chip breakers generally provided on the rake face of an insert are formed by the top and bottom punches.

Cutting tool inserts generally have a hole for clamping them to a tool holder by a screw. The holes generally have a noncylindrical shape such as trumpet style in order to more securely fasten the inserts to the holder.

Inserts can be either radial or tangential. Radial inserts are oriented in such a manner that the cutting forces are directed along a thinner dimension of the insert. The clamping hole extends from a rake face to an opposite face, i.e., a bottom face or a rake face. The rake faces generally having chip breakers formed by the punches in the pressing operation. Clamping holes are in this case parallel to the main pressing direction and are easily formed with satisfactory accuracy.

Tangential inserts are oriented in an insert holder in such a way that during a cutting operation the cutting forces are directed along a thicker dimension of the insert. An advantage of such an arrangement is that the insert withstands greater cutting forces. In other cases limitations in the available space for mounting may motivate the choice of a tangential insert design. In the case of a tangential insert the clamping hole is perpendicular to the main pressing direction and such inserts have to be produced by more complex methods.

Methods for manufacturing tangential cutting inserts having a noncylindrical cross-hole, FIG. 1, include a method in which the powder is compacted in a die by top and bottom punches to a body. The cross-hole is subsequently machined in the body which then is sintered. The hole obtained in this way fulfills the dimensional requirements. However, the machining of the body is very time consuming which makes the insert expensive to manufacture. It is therefore desirable to produce inserts with a cross-hole directly in the pressing operation.

U.S. Pat. No. 6,645,426 discloses a method comprising a step of filling powder into a cavity formed of a die having in a vertical direction a die hole including a cross-hole. The powder is filled in the cavity and pre-compacted by the top and bottom punches. A punch-out pin is then inserted into the powder, the shape of the cross-hole is punched out by the punch-out pin. Thereafter, the powder is compacted by means of the top and bottom punches to its final density. The punch-out pin is thereafter pulled out of the green compact and the green compact is taken out so that a completed product can be obtained. A major weakness with this method is its limitation to produce only cylindrical cross-holes and the waste of powder due to the punched-out volume. There is also a potential risk of defects around the hole entrances.

U.S. Pat. No. 6,986,866 discloses a method to produce inserts with a cross-hole directly in the pressing operation based on uni-axial pressing in a die by top and bottom punches by:

- positioning the bottom punch in the die below a core bore,
- positioning movable core rods in the cavity in a position where the rods are in contact with each other,
- filling the cavity with powder,
- positioning the powder about the core rods to control the location of the opening after sintering,
- compressing the powder uniformly about the core rods,
- retracting the top and bottom punches for decompression of the green part,
- retracting the core rods from the cavity and
- ejecting the green part from the die.

In this manufacturing method it is difficult to obtain a uniform density due to significant differences of the ratio of pressed height to fill height which makes it necessary to modify the shape of the core pins in order to obtain the desired shape and dimensions after sintering. Another drawback is the obvious risk of powder sticking to the end surfaces of the core rods making it impossible to move them into the desired closed position or causing damage of the core rods in the contact area. A third drawback is the flash formed in a direction radial to the core rods where the core rods meet.

JP 10-146695 discloses a method to obtain a green compact by means of uni-axial pressing using two top and/or two bottom punches and a core rod during the compaction of the powder and thereby avoid modifications of the core pin. The problem with this method is to obtain a sufficiently uniform density distribution around the hole since the surface of the hole towards the top punches and bottom punches is curved. The method will also cause flashes in the partings between the divided top and bottom punches.

SUMMARY

It is an object of the present invention to provide an improved method for manufacturing compacted powder bodies such as cutting inserts with a noncylindrical cross-hole with improved dimensional accuracy.

An exemplary method of making a cutting insert using powder metallurgical methods in a press having a main pressing direction a press tool setup with a die, a male core rod, a female core rod, a bottom punch, a top punch and a feed shoe, the insert having a noncylindrical hole perpendicular to the main pressing direction, is disclosed. The method comprises the following steps: moving the bottom punch down in the die to a punch filling position below the male core rod and the female core rod; positioning the male core rod and the female core rod to respective core rod filling positions; filling the die cavity with a desired amount of powder; moving the bottom punch in the die to distribute the powder evenly around the male core rod and the female core rod; moving the top punch and bottom punch to a final punch position to compact the powder to form a compact; retracting the top and bottom punches and, optionally, the male core rod and the female core rod to unload the compact; and retracting the male core rod and the female core rod to a position that allows ejection of the compact, wherein the powder is compacted by moving the male core rod and the female core rod to a final core rod position.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which:

FIG. 1 illustrates a tangential cutting insert.

FIG. 2 illustrates a press tool setup in which: 2—Die; 4—Core rod, male; 6—Core rod, female; 8—Bottom punch, the bottom punch may be divided into several punches if desired; 10—Top punch, the top punch may be divided into several punches if desired; 12—Feed shoe; and 14—Powder.

DETAILED DESCRIPTION

The disclosed method manufactures cutting inserts with a noncylindrical cross-hole using a multi-axial press which solves the problem to obtain a uniform compacted density around the cross-hole. The die has a bore perpendicular to the main pressing direction through its cavity where the core rods forming the cross-hole are located. The front parts of the core rods have such a shape that a cross hole with the desired noncylindrical shape is obtained. The core rods are, according one embodiment, male and female and, thus, movable also in the compaction step of the manufacturing sequence enabling compaction with the core rods. It has surprisingly been found that this compaction makes it possible to control the density distribution within the part to such an extent that the desired shape and dimensions of the cross-hole can be obtained without any time and cost consuming compensation of the shape of the core rods, which often is the case for cross-holes produced according to prior art methods. The density distribution within the compact which controls the final shape and dimensions of the cross-hole after sintering appears to be dependent not only on the relative motion between the top and bottom punches and die like in uni-axial pressing but to a large extent also to the motion of the core rods.

Figure 3A:
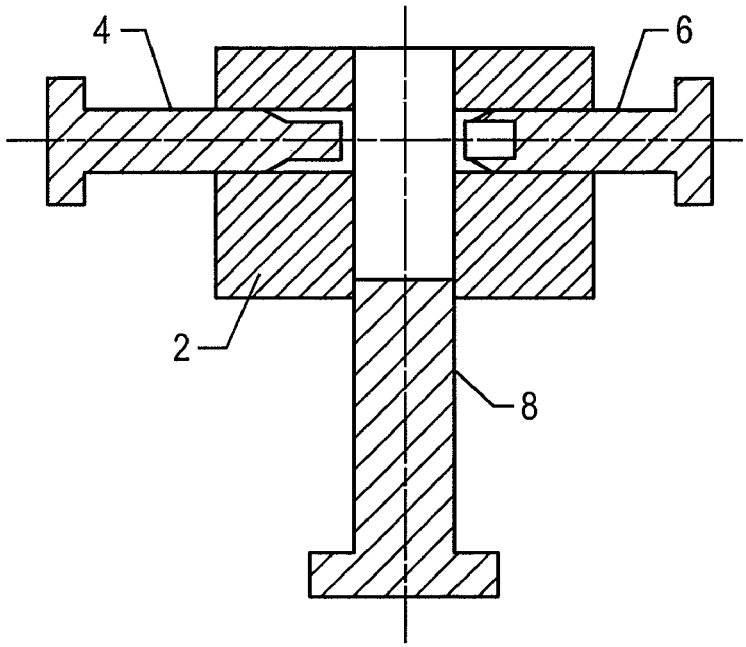
FIGS. 3A to 3H illustrate the manufacturing sequence.
Figure 3B:
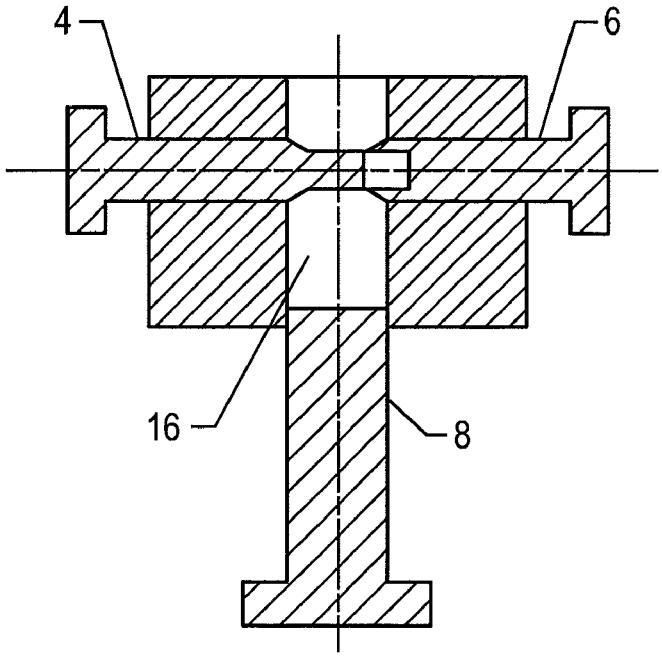

The manufacturing steps are as follows:

In FIGS. 3A-3B: The bottom punch 8 moves down in the die 2 to a position below the core rods 4,6, preferably to the filling position.

In FIG. 3B: The core rods 4,6 are positioned to their filling position.

Figure 3C:
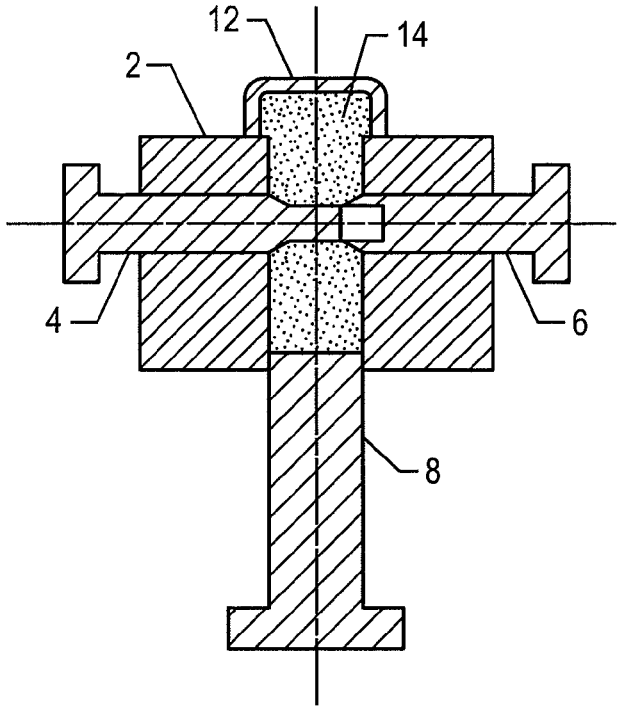

In FIG. 3C: The die cavity 16 is filled with a desired amount of powder 14.

Figure 3D:
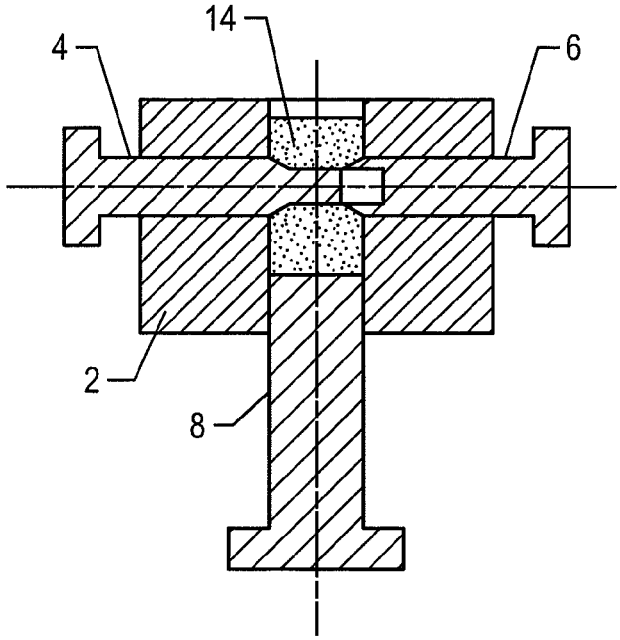

In FIG. 3D: The bottom punch 8 moves in the die 2 to distribute the powder 14 evenly around the core rods 4,6.

Figure 3E:
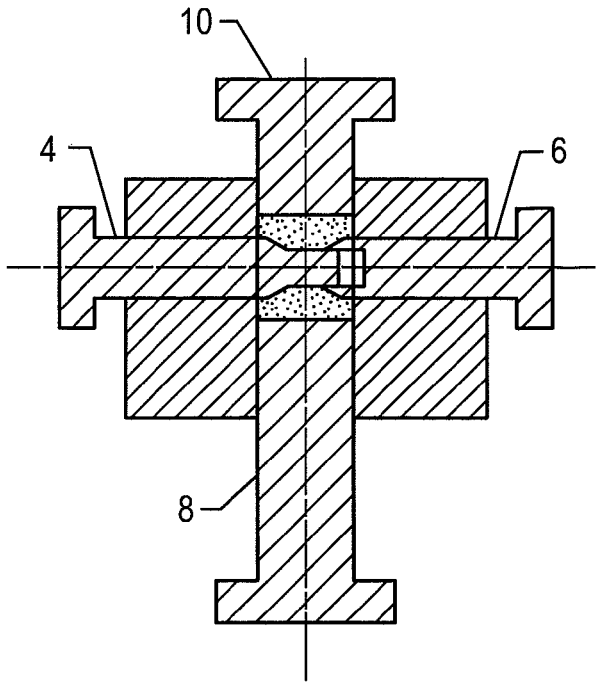

In FIG. 3E: The top punch 10 is positioned in the die 2 over the cavity 16.

Figure 3F:
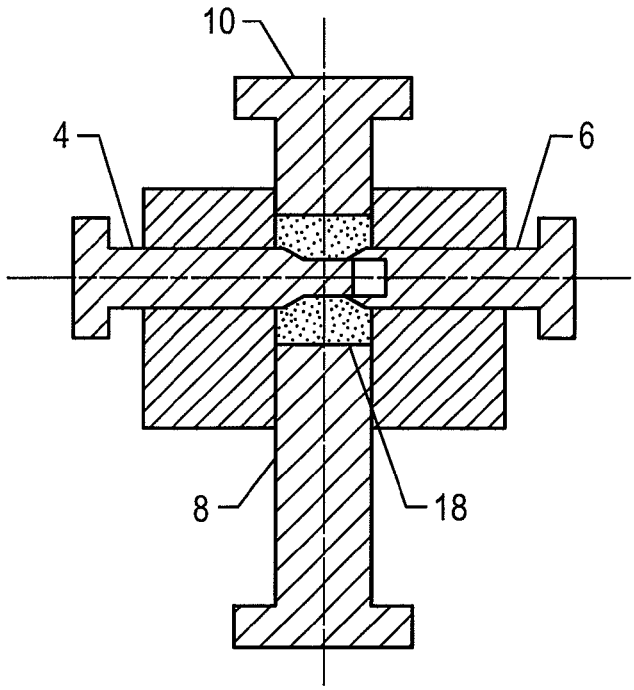

In FIG. 3F: The top punch 10 and bottom punch 8 and the two core rods 4,6 move toward a final position to compact the powder 14 to obtain the desired density within the compact 18. Preferably, the density distribution is homogeneous. Preferably, the top punch 10 and bottom punch 8 are allowed to precompact the powder 14 before the movement of the core rods 4,6 starts.

Figure 3G:
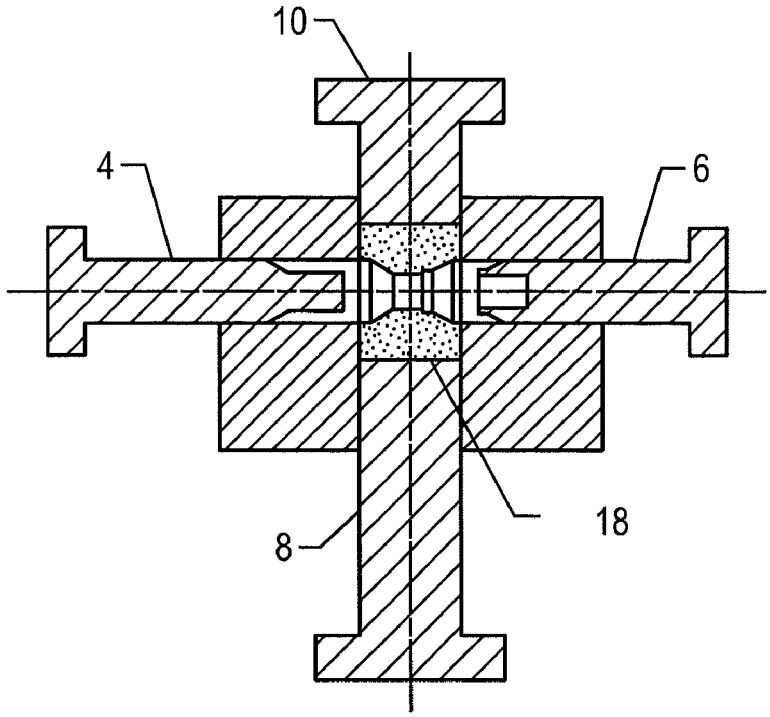

In FIG. 3G: The top punch 10 and bottom punch 8, and possibly the core rods 4,6, retract, unloading the compact 18.

Figure 3H:
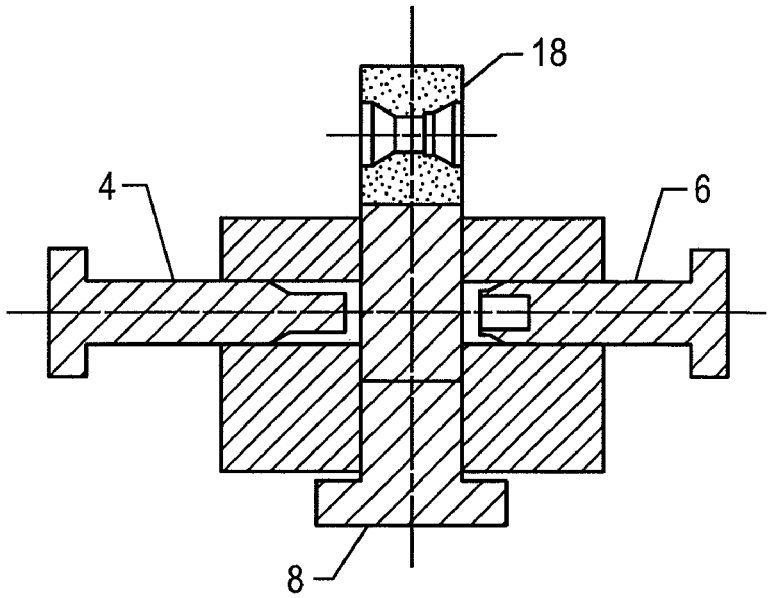

In FIG. 3H: The core rods 4,6 retract to allow ejection of the compact 14.

Finally, the compact 18 is ejected.

EXAMPLE 1

Tangential cutting tool inserts for crank shaft milling with a cross-hole of 4.4 to 6.1 mm diameter having a tolerance on the dimension of ±0.1 mm with composition of 10% Co and the balance WC were manufactured according to the disclosed method. The pressure in the main pressing direction was about 170 MPa on each punch. An active compaction step of 0.5 mm with the core rods during the last 0.5 mm compaction step of the top and bottom punch was applied. As a result the pressure on the core rods increased to about 320 MPa. The inserts were sintered according to standard production. After sintering the dimension of the cross-hole was examined using a coordinate measuring machine. It was found that the dimension of the cross-hole was 5.86 mm.

EXAMPLE 2

Example 1 was repeated according to U.S. Pat. No. 6,986,866. The pressure in the main pressing direction was about 190 MPa on each punch. It was found that the pressure in the direction of the core rods was about 100 Mpa. It was found that the dimension of the cross-hole was 5.65 mm.

The examples show that the presently disclosed method makes it possible to control the dimension of the cross hole without changing the main dimensions of the sintered part. This means that the cross-hole dimension, in the examples, can be controlled between from about 5.65 mm to about 5.86 mm depending on compaction pressure on the core rod. In case of example 2 this cannot be done without modification of the press tool. This enhanced control makes it possible to reach the target value for the desired hole dimension without effecting the dimensions of the insert.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A method of making a cutting insert using powder metallurgical methods in a press having a main pressing direction a press tool setup with a die, a male core rod, a female core rod, a bottom punch, a top punch and a feed shoe, the insert having a non-cylindrical hole perpendicular to the main pressing direction, the method comprising the following steps:

moving the bottom punch down in the die to a punch filling position below the male core rod and the female core rod;

positioning the male core rod and the female core rod to respective core rod filling positions;

filling the die cavity with a desired amount of powder;

moving the bottom punch in the die to distribute the powder evenly around the male core rod and the female core rod;

moving the top punch and bottom punch to a final punch position to compact the powder to form a compact and moving the male core rod and the female core rod to a final core rod position to compact the powder;

retracting the top and bottom punches and, optionally, the male core rod and the female core rod to unload the compact; and retracting the male core rod and the female core rod to a position that allows ejection of the compact.

2. The method according to claim 1, wherein the powder is precompacted by the top and bottom punches prior to being compacted by the male core rod and the female core rod.

3. The method according to claim 1, wherein the compact has a homogeneous density distribution.

* * * * *